United States Patent [19]

Breunig

[11] Patent Number: 4,700,946

[45] Date of Patent: Oct. 20, 1987

[54] EXERCISE DEVICE

[76] Inventor: Donald E. Breunig, 108 E. Arnold Rd., Sandwich, Ill. 60548

[21] Appl. No.: 786,473

[22] Filed: Oct. 11, 1985

[51] Int. Cl.[4] ..... A63B 21/00

[52] U.S. Cl. ..... 272/134; 272/120; 272/144; 272/73; 128/25 R

[58] Field of Search ..... 272/73, 117, 118, 120, 272/134, 144, DIG. 5, 132; 128/25 R, 25 B

[56] References Cited

U.S. PATENT DOCUMENTS

| | | | |
|---|---|---|---|
| 42,516 | 4/1864 | Taylor . | |
| 2,362,111 | 12/1941 | Burns . | |
| 2,673,737 | 3/1954 | Daniels . | |
| 2,724,592 | 11/1955 | Pfaus . | |
| 2,759,730 | 8/1956 | Berry . . | |
| 3,219,341 | 11/1965 | Weinstein | 272/120 |
| 3,643,943 | 2/1972 | Erwin, Jr. et al. | 272/DIG. 5 X |
| 3,754,547 | 8/1973 | Walker | 128/25 R |
| 3,892,404 | 7/1975 | Martucci . | |
| 3,964,742 | 6/1976 | Carnielli | 272/73 |
| 4,084,815 | 4/1978 | Flannery | 272/126 X |
| 4,101,124 | 7/1978 | Mahnke | 272/134 |
| 4,125,258 | 11/1978 | McArthur | 272/144 X |
| 4,176,836 | 12/1979 | Coyle | 272/120 |
| 4,285,515 | 8/1981 | Gezari | 272/73 |
| 4,372,551 | 2/1983 | Yurdin | 272/134 X |
| 4,468,025 | 8/1984 | Sferle | 272/120 |
| 4,519,604 | 5/1985 | Arzoonian | 128/25 R X |
| 4,549,733 | 10/1985 | Salyer | 272/118 |
| 4,609,189 | 9/1986 | Brasher | 272/118 |

FOREIGN PATENT DOCUMENTS

| | | | |
|---|---|---|---|
| 1500390 | 11/1967 | France | 128/25 R |

*Primary Examiner*—Richard J. Apley
*Assistant Examiner*—Robert W. Bahr
*Attorney, Agent, or Firm*—Leydig, Voit & Mayer

[57] ABSTRACT

The disclosure describes an exercise device which allows a user to exercise against a resistance proportional to his own weight and which comprises a base, a track mechanism pivotally mounted to the base, and a structure for supporting the user. The support structure is mounted to the track mechanism for linear displacement along the track mechanism at a generally constant orientation with respect to the base. The exercise device also comprises an arrangement interconnected between the track mechanism and the base for varying the angle between the track mechanism and base without varying the orientation of the support structure with respect to the base. Further, the exercise device comprises a post assembly attached to the base. The post assembly includes a post for mounting at least one exercise apparatus and a mechanism for adjusting the distance between the mounting post and the track mechanism.

20 Claims, 3 Drawing Figures

DEGREE OF ELEVATION

| Weight | 0° | 2° | 4° | 6° | 8° | 10° | 12° | 14° | 16° | 18° | 20° | 22° | 24° | 26° | 28° | 30° |
|---|---|---|---|---|---|---|---|---|---|---|---|---|---|---|---|---|
| 115 | 11.5 | 15.5 | 20 | 24 | 28 | 32 | 37 | 41 | 45 | 50 | 55 | 60 | 65 | 71 | 76 | 82 |
| 120 | 12 | 16 | 20.5 | 25 | 29 | 34 | 38 | 43 | 47 | 53 | 58 | 63 | 68 | 74 | 80 | 86 |
| 125 | 12.5 | 17 | 21 | 26 | 30.5 | 35 | 40 | 45 | 49 | 55 | 60 | 65 | 71 | 77 | 83 | 89 |
| 130 | 13 | 18 | 22 | 27 | 32 | 37 | 42 | 47 | 51 | 57 | 63 | 68 | 74 | 80 | 86 | 93 |
| 135 | 13.5 | 19 | 23 | 28 | 33 | 38 | 43 | 48 | 53 | 59 | 65 | 71 | 77 | 83 | 90 | 97 |
| 140 | 14 | 19 | 24 | 29 | 34 | 39 | 45 | 50 | 55 | 61 | 67 | 73 | 80 | 86 | 93 | 100 |
| 145 | 14.5 | 20 | 25 | 30 | 35 | 41 | 46 | 52 | 57 | 64 | 70 | 76 | 83 | 89 | 96 | 104 |
| 150 | 15 | 20.5 | 26 | 31 | 37 | 42 | 48 | 54 | 59 | 66 | 72 | 79 | 86 | 92 | 100 | 108 |
| 155 | 15.5 | 21 | 27 | 32 | 38 | 44 | 50 | 56 | 61 | 68 | 75 | 81 | 89 | 95 | 103 | 111 |
| 160 | 16 | 21.6 | 27.5 | 33 | 39 | 45 | 51 | 57 | 63 | 70 | 77 | 84 | 92 | 98 | 106 | 115 |
| 165 | 16.5 | 22 | 28 | 34 | 40 | 46 | 53 | 59 | 65 | 72 | 79 | 86 | 95 | 102 | 110 | 118 |
| 170 | 17 | 23 | 29 | 35 | 41 | 48 | 54 | 61 | 67 | 75 | 81 | 89 | 98 | 105 | 113 | 122 |
| 175 | 17.5 | 23.7 | 30 | 36 | 43 | 49 | 56 | 63 | 69 | 77 | 84 | 92 | 100 | 108 | 116 | 126 |
| 180 | 18 | 24.5 | 31 | 37 | 44 | 51 | 57 | 65 | 71 | 79 | 86 | 95 | 102 | 111 | 120 | 129 |

53

FIG. 3

EXERCISE DEVICE

TECHNICAL FIELD

The present invention relates to exercise devices. In particular, it relates to a device which enables a person to exercise against the resistance of his own weight.

BACKGROUND ART

Many known exercise devices allow a person to work against the resistance of his own weight. For example, the exercise device disclosed in U.S. Pat. No. 3,892,404 comprises a carriage mounted on wheels to a pair of parallel track members. At one end, a pair of support posts maintain the track members at a desired inclination. The user may then sit on the carriage, lock his feet in a pair of foot rests, and propel himself and the carriage along the inclined track members by means of his leg muscles.

While exercise devices which allow a person to work against the resistance of his own weight may be both reliable and effective, they frequently have several undesirable characteristics. For example, the carriage is typically positioned at the same inclination as the track members. Consequently, when the track members are positioned at an inclination steep enough to provide an effective workout, the user may experience considerable difficultly and discomfort in sitting on the steeply inclined carriage. This problem is particularly burdensome for someone with reduced physical capacity who is using the device for rehabilitation.

Further, the variety of exercises offered by many of these devices is frequently limited. Users may move back and forth along the track members by means of their legs or, perhaps, their arms, but few other exercises are available.

DISCLOSURE OF THE INVENTION

A general object of the invention is to provide an improved exercise device. More specific objects include providing an exercise device which is convenient and comfortable to use, even for a person with reduced physical capacity, and which offers a wide variety of exercises.

Accordingly, the present invention may be embodied by an exercise device which comprises a base, a track mechanism pivotally mounted to the base, and a structure for supporting a user. The support structure is mounted to the track mechanism for linear displacement along the track mechanism at a generally constant orientation with respect to the base. The exercise device further also comprises an arrangement interconnected between the track mechanism and the base for varying the angle between the track mechanism and the base without varying the orientation of the support structure with respect to the base. Further, the exercise device comprises a post assembly attached to the base. The post assembly includes a post for mounting at least one exercise apparatus and a mechanism for adjusting the distance between the mounting post and the track mechanism.

The invention may also be embodied by an exercise device which comprises a frame, a track mechanism pivotally mounted to the frame, and a structure which supports a user and which is mounted to the track mechanism for linear displacement along the track mechanism. The exercise device further comprises an arrangement connected between the frame and the track mechanism for adjustably inclining the track mechanism with respect to the frame, a post which is attached to the frame and to which at least one exercising apparatus may be mounted, and a mechanism for adjusting the distance between the post and the track mechanism. An exercise device constructed and operated in accordance with the present invention offers many special features. For example, the user may vary the inclination of the track mechanism and move back and forth along the track mechanism while maintaining a generally constant orientation with respect to the base. For example, if the support structure is oriented horizontally, it will remain horizontal regrdless of how steeply the track mechanism is inclined with respect to the base. This feature is particularly useful for a person with reduced physical capacity who is using the exercise device for purposes of rehabilitation. As another example, user may not only move back and forth along the track mechanism but may also utilize any of the exercise apparatus mounted to the post. For example, a restorator, i.e., a set of pedals, may be mounted to the post so the user can exercise either his legs or arms. The adjustment mechanism allows the exercise apparatus to be conveniently positioned in accordance with the physical characteristics of the user. This feature is, again, highly convenient when the exercising device is being used for purposes of rehabilitation.

BRIEF DESCRIPTION OF THE DRAWINGS

FIG. 3 is a chart attached to the exercise device shown in FIG. 1.

BEST MODE FOR CARRYING OUT THE INVENTION

Figure 1:
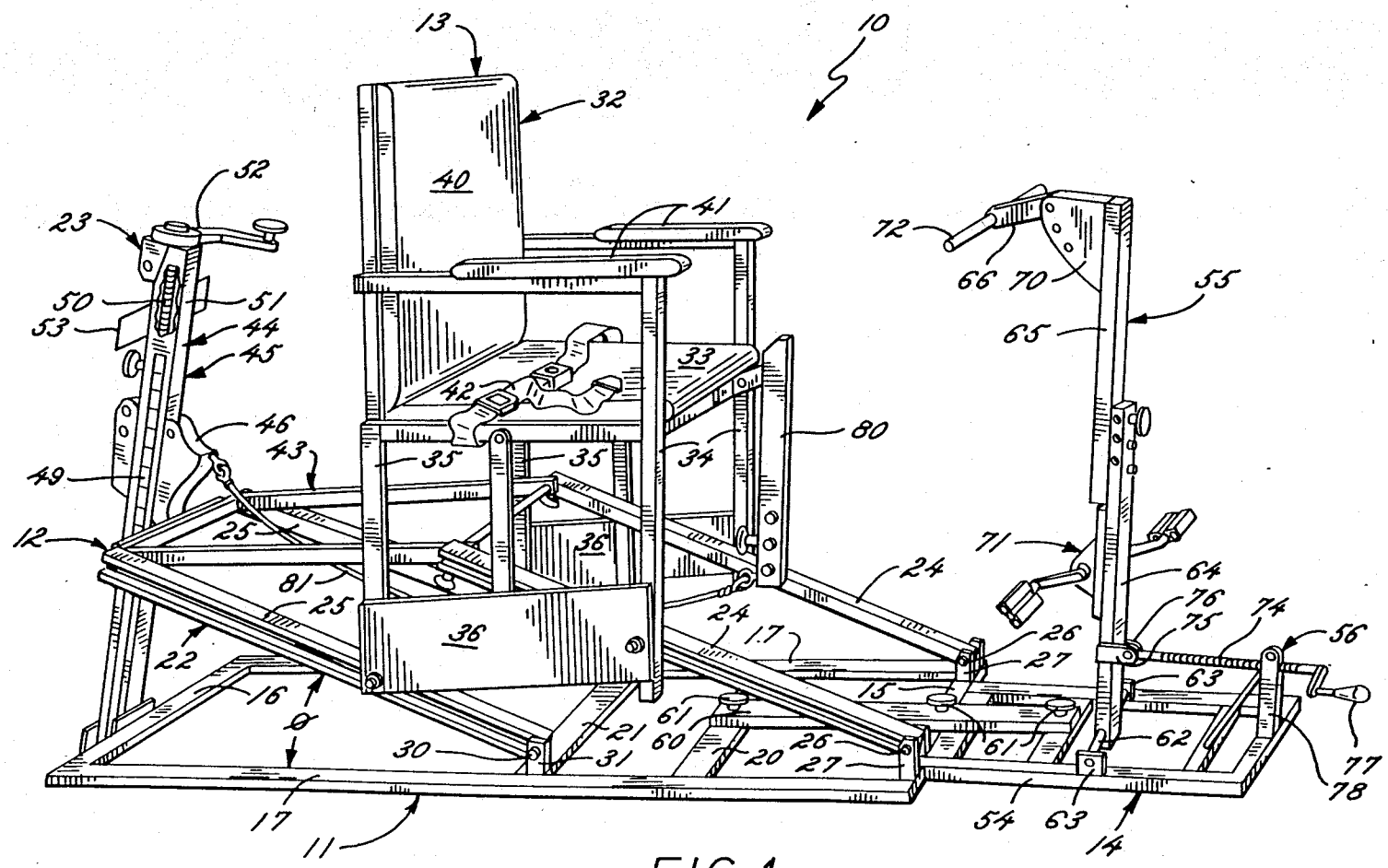
FIG. 1 is an isometric view of an exercise device embodying the present invention.

As shown in FIG. 1, an exemplary exercise device 10 embodying the present invention generally comprises a frame or base 11, an adjustable track assembly 12, a user support assembly 13, and an adjustable apparatus mount 14. The base 11, which may be variously configured to provide adequate stability, includes front, rear and opposite side frame members 15, 16, 17 fixedly joined in a rectangular configuration. For additional strength, front and rear cross members 20, 21 are fixedly joined between the side members 17. The various members of the base 11 may be fashioned from any sufficiently strong, rigid material including, for example, metal bar or channel stock, and joined in any suitably fixed manner, including welding or bolting.

The adjustable track assembly 12 comprises a track mechanism 22 pivotally attached to the base 11 and an inclining apparatus 23 for varying the angle $\phi$ between the track mechanism 22 and the base 11. While any of several suitable configurations of the track mechanism 22 would adequately bear the user support assembly 13, the track mechanism 22 of the exemplary exercise device 10 includes four equally long track members 24, 25. The front track members 24 each pivot about pivot pins 26 mounted in upwardly extending brackets 27 on the front frame member 15, rotating through vertical planes parallel to the side frame members 17. The rear track members 25 are spaced from the front track members 24 in a direction having a component parallel to the vertical planes and similarly pivot about pivot pins 30 mounted in upwardly extending brackets 31 on the rear cross member 21. Both the front and rear track members 24, 25 are preferably fashioned from metal channel sections having U-shaped cross-sections which open outwardly, as shown in FIG. 1.

The user support assembly 13 is mounted to the track mechanism for linear displacement along the track members 24, 25. In the exemplary exercise device 10, the user support assembly 13 comprises a chair 32 having a seat 33, two front legs 34 and two rear legs 35 depending from the corners of the seat 33, and two cross braces 36 rigidly connected between each pair of front and rear legs 34, 35. While other suitable user support assemblies 13 may be envisioned including, for example, a bench, the chair 32 is preferable because it provides the additional comfort and security of a backrest 40 and two armrests 41. The user support assembly 13 may additionally include a seat belt 42 to further secure the user in place. The backrest 40, armrests 41 and seat belt 42 are particularly important for a user with reduced physical capacity who is using the exercise device 10 for purposes of rehabilitation because they greatly reduce the risk of falling from the device 10.

To facilitate movement back and forth along the track mechanism 22, each front and rear leg 34, 35 of the chair 33 is mounted via a roller (not shown) within the channel of each front and rear track member 24, 25, respectively. In this manner, the user support assembly 13 is mounted to the track mechanism 22 at a predetermined orientation with respect to the base 11 and this orientation is maintained as the user support assembly 13 moves back and forth along the track members 24, 25. In the exemplary exercise device 10, both the user support assembly 13 and the base 11 are oriented generally horizontally.

In accordance with one aspect of the invention, the inclining apparatus 23 varies the angle $\phi$ of the track mechanism 22 with respect to the base 11 without varying the orientation of the user support assembly 13 with respect to the base 11. Consequently, the user may adjust the inclination of the track members 24, 25 and move back and forth along the track members 24, 25 while maintaining a constant orientation with respect to the base 11. This greatly facilitates use of the exercise device 10 by any user but is especially significant for a user with reduced physical capacity since it allows him to exercise both safely and comfortably regardless of how steeply inclinded the track members 24, 25 may be.

The inclining apparatus 23 of the exemplary exercise device 10 comprises a bracket 43 and a manually-operated crank mechanism 44 for vertically displacing the bracket 43, although a motor driven assembly could alternatively be utilized. The bracket 43 is fashioned in a rectangular configuration from four rigidly interconnected metal bars. The upper ends of the track members 24, 25 are pivotally mounted to the corners of the bracket 43 with the distance between the upper ends of the each pair of front and rear track members 24, 25 equal to the distance between the lower ends. Thus, as the bracket 43 is vertically displaced by the crank mechanism 44, the angles $\phi$ between the track members 24, 25 and the base 11 remain equal and the orientation of the user support assembly 13 remains constant.

To vertically displace the bracket 43, the crank mechanism 44 includes a screw assembly 45 and a linkage 46 interconnected between the screw assembly 45 and the bracket 43. The screw assembly 45 comprises a drive-and-support screw 50 for rotation within a housing 51. The lower end of the housing 51 is pivotally mounted to the base 11, and a crank 52 fixed to the screw 50 extends from the upper end of the housing 51. The linkage 46 is pivotally mounted to the bracket 43 on one end. On the other end, the linkage is mounted to the screw 50 and the housing 51 so that, as the screw 50 is rotated by the crank 52, the linkage 46 moves up or down the screw 50, sliding along the housing 51 and vertically displacing the attached bracket 43. As the bracket 43 moves up or down with the linkage 46, the angle $\phi$ between the attached track members 24, 25 and the base 11 varies accordingly. A scale 49 is attached to the housing 51 for indicating the track angle $\phi$ in accordance with the height of the linkage 46. As shown in FIGS. 1 and 3, a chart 53 which correlates the track angle $\phi$ with the weight of the user and which indicates the resistance encountered by the user in moving up the track mechanism 22 may be attached to the housing 51 or elsewhere on the exercise device 10. Alternatively, this function may be performed electronically.

Figure 2:
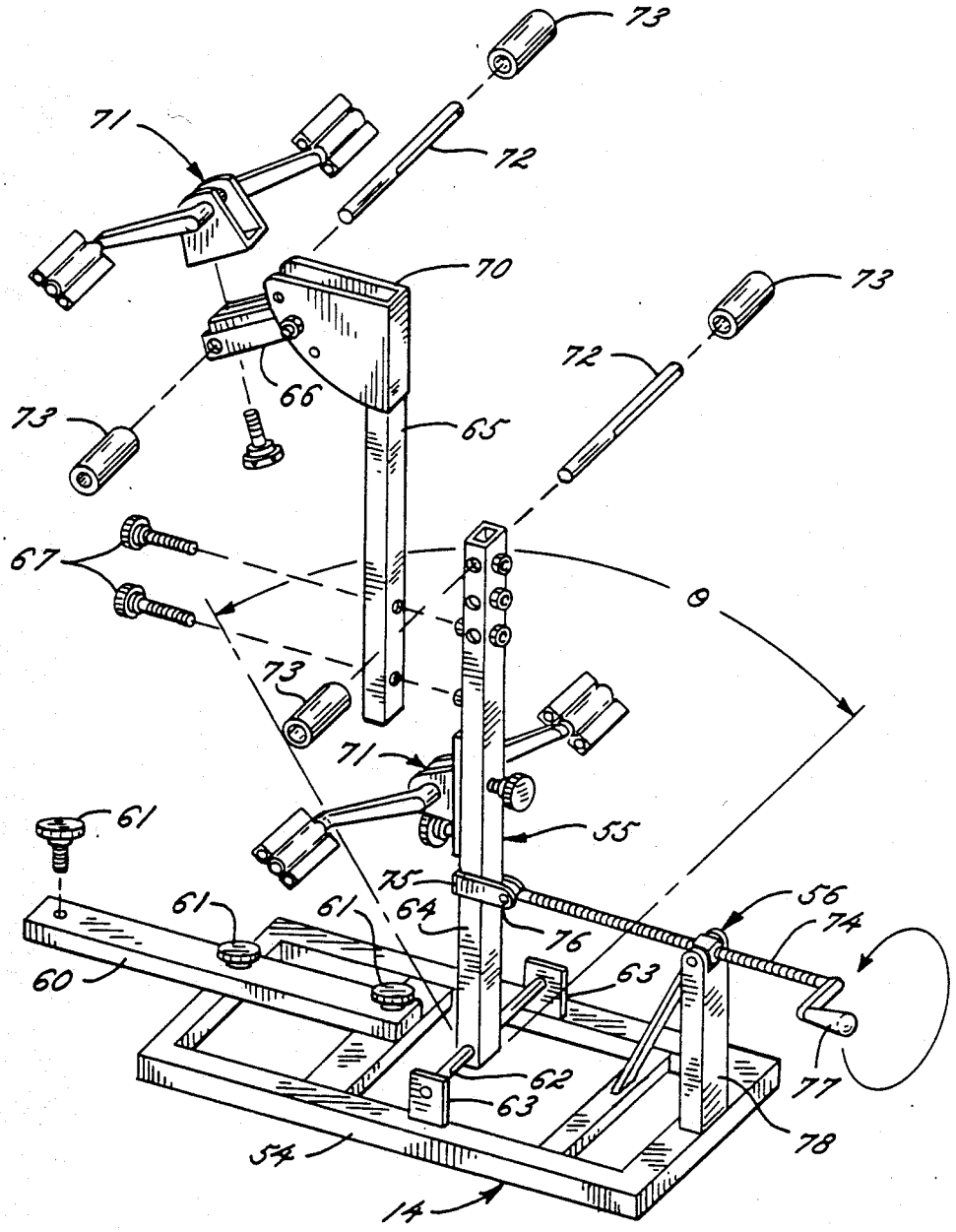
FIG. 2 is an exploded isometric view of the apparatus mount for the exercise device shown in FIG. 1.

To provide a site from which the user may push himself and the user support assembly 13 along the track mechanism 22, the apparatus mount 14 is attached to the front of the base 11. The apparatus mount 14 includes a rectangular frame 54, a mounting post 55, and a crank assembly 56. The frame 54 is preferably attached to the base 11 by means of a connecting bar 60 held in place by knob-ended bolts 61. The mounting post 55 is pivotally mounted to the frame 54 by means of an axle 62 which extends between upstanding brackets 63. As shown in FIG. 2, the mounting post 55 comprises three sections 64–66, each preferably fabricated from square metal tubing. The lower end of the first section 64 is pivotally mounted to the frame 54. The lower end of the second section 65 is detachably mounted to the upper end of the first section 64 by knob-ended bolts 67. Finally, the upper end of the second section 65 is pivotally mounted. to the third section 66 with the angle between them being adjustably maintained by a bracket-and-bolt arrangement 70.

In accordance with another aspect of the invention, various exercising apparatus may be mounted to the post 55 in a variety of locations. For example, a restorator 71 may be detachably mounted to the first section 64 to permit the user to exercise his legs when the chair 32 is at the lower end of the track mechanism 22. Alternatively, the restorator 71 could be mounted to the third section 66, allowing the user to exercise his arms. Similarly, a stationary bar 72 with cushions 73 on each end may be mounted to the first section 64, allowing the user to push the user support assembly 13 up the track members 24, 25 with his legs. Alternatively, the stationary bar 72 may be mounted to the third section 66, allowing the user to push the user support assembly 13 up the track members 24, 25 with his arms. In this manner, the mounting post 55 permits a wide variety of exercises to be performed by the user.

To enable the mounting post 55 to be adjusted to fit the physical characteristics of a particular user, the crank assembly 56 is mounted between the frame 54 and the mounting post 55. The crank assembly 56 includes a crank screw 74 pivotally mounted at one end to the mounting post 55 by a bracket 75 and pivot pin 76. A crank 77 is attached to the opposite end of the crank screw 74. Intermediate its ends, the crank screw 74 is mounted for rotation to a screw mount 78 which is fixedly attached to the frame 54. By turning the crank 77, the user may pivot the mounting post 55 through an angle 8, varying the distance between the mounting post 55 and the front end of the track mechanism 22.

In the preferred mode of operation, the user first sets the track angle $\phi$ by means of the crank mechanism 44 to provide the desired amount of resistance. The desired exercise apparatus is then attached to the mounting post in the desired location, e.g., the stationary bar may be attached to the third section 66, as shown in FIG. 1. The user then positions the mounting post 55 by means of the crank 77 to provide a comfortable range of motion. Once these parameters have been established, the user sits in the chair 32, fastens the seat belt 42, and commences his exercise, e.g., repeatedly pushing himself and the user support assembly 13 up the track members 24, 25 by means of the stationary bar 72. Alternatively, the user may exercise his legs by means of an extension 80 pivotally mounted to the seat 33 midway between the front legs 34 of the chair 32 and a cable 81 connected between the end of the extension 80 and the linkage 46. With the stationary bar 72 removed from the mounting post 55 and attached to the end of the extension 80, the user may position his ankles under the stationary bar 72 and then straighten his legs, pivoting the extension in an upward direction and forcing the user and the user support assembly 13 upward along the track members 24, 25.

Although the present invention has been described in terms of a single embodiment, it is not limited to that embodiment. Alternative embodiments and modifications which would still be encompassed by the invention may be made by those skilled in the art, particularly in light of the foregoing teachings. Therefore, the following claims are intended to cover any alternative embodiments, modifications or equivalents which may be included within the spirit and scope of the invention as defined by the claims.

I claim:

1. An exercise device which allows a user to exercise against a resistance proportional to his own weight, said exercise device comprising a base, a track mechanism pivotally mounted to the base, means for supporting the user, said supporting means being mounted to the tack mechanism for linear displacement along the track mechanism at a generally constant orientation with respect to the base, means interconnected between the track mechanism and the base for varying the angle between the track mechanism and the base without varying the orientation of the supporting means with respect to the base, whereby the user may vary the inclination of the track mechanism and move along the track mechanism while maintaining a generally constant orientation with respect to the base, and post means attached to the base for mounting at least one exercising apparatus, the post means including a mounting post and means for adjusting the distance between the mounting post and the track mechanism.

2. The exercise device as claimed in claim 1 wherein the track mechanism includes at least one track member having first and second ends pivotally mounted to the base and the angle varying, means, respectively, said supporting means being mounted to the track member for linear displacement between the first and second ends.

3. The exercise device as claimed in claim 2 wherein said supporting means includes a chair having at least one leg mounted to the track member for linear displacement between the first and second ends.

4. The exercise device as claimed in claim 3 wherein said chair includes a seat and means for securing the user in the seat.

5. The exercise device as claimed in claim 1 wherein said track mechanism includes at least first and second track members having first and second ends, said first track member being pivotally mounted at the first end to the base for rotation within a plane, and said second track member being pivotally mounted at the first end to the base spaced from the first track member in a direction having at least one component parallel to the plane, and wherein the angle varying means includes a bar member pivotally mounted to the second ends of the track members and means for vertically displacing the bar member, said track members having substantially equal lengths and extending from the base at substantially equal angles.

6. The exercise device as claimed in claim 5 wherein said vertically displacing means comprises a screw assembly including a screw pivotably mounted at one end to the base and means connected between the screw and the bar member for axially displacing the bar member in response to rotation of the screw.

7. The exercise device as claimed in claim 1 wherein the supporting means is oriented generally horizontally.

8. The exercise device as claimed in claim 1 further including means mounted to the exercise device for correlating the weight of the user and the angle between the track mechanism and the base and indicating the resistance encountered by the user in moving along the track mechanism.

9. The exercise device as claimed in claim 1 wherein the post means further includes a frame, the post being pivotally mounted to the frame and the frame being detachbaly mounted to the base.

10. The exercise device as claimed in claim 9 wherein the post includes first, second and third sections, each having first and second ends, the first end of the first section being pivotally mounted to the frame, the first end of the second section being detachably mounted to the second end of the first section, and the first end of the third section being mounted to the second end of the second section for angular displacement relative to the second section.

11. The exercise device as claimed in claim 9 wherein said distance adjusting means comprises an adjustment screw and a screw mount attached to the frame, said adjustment screw being pivotally mounted to the post and rotatably engaged with the screw mount whereby, by rotating the adjustment screw, the post may be pivoted with respect to the frame, thereby adjusting the distance between the post and the track mechanism.

12. The exercise device as claimed in claim 1 wherein said one exercise apparatus comprises a restorator.

13. An exercise device which allows a user to exercise against a resistance proportional to his own weight, said exercise device comprising a frame, a track mechanism including at least first and second track members, said first track member being pivotally mounted to the frame for rotation within a plane and second track member being pivotally mounted to the frame spaced from the first track member in a direction having a component parallel to the plane, means for supporting the user, said supporting means being mounted to the track mechanism for linear displacement along the track members at a generally constant orientation with respect to the frame, means connected between the track mechanism and the frame for varying the angle between the track members and the frame without varying the orientation of the supporting means with respect to the frame, post means mounted to the frame proximate the track mechanism for supporting at least one exercising apparatus, and means for varying the distance between the post means and the track mechanism.

14. The exercise device as claimed in claim 13 wherein the angle varying means includes a bar member pivotally connected to the track members and means for vertically displacing the bar member, said track members extending at substantially equal angles from the frame and through substantially equal lengths between the frame and the bar member.

15. The exercise device as claimed in claim 14 wherein the vertically displacing means comprises a screw assembly including a screw pivotally mounted to the frame and means connected between the screw and the bar member for axially displacing the bar member is response to rotation of the screw.

16. The exercise device as claimed in claim 15 wherein the post means includes a post pivotally mounted to the frame and the distance varying means includes a screw mount attached to the frame and a screw pivotally connected to the post and rotatably engaged with the screw mount whereby rotating the screw pivots the post.

17. The exercise device as claimed in claim 16 wherein the track mechanism comprises four track members, each pivotally mounted to the frame, wherein the supporting means comprises a chair assembly including a seat, a seat belt for securing the user in the seat, and four legs extending from the seat, each leg mounted to a track member for linear displacement along the track member, and wherein the angle varying means includes a bracket comprising four rigidly interconnected bar members pivotally mounted to the four track members.

18. The exercise device as claimed in claim 17 further comprising means mounted to the exercise device for correlating the weight of the user and the angle between the track members and the frame and indicating the resistance encountered by the user in moving along the track members.

19. The exercise device as claimed in claim 13 wherein the frame includes first and second frame sections detachably mounted to each other, said first frame section being joined to the track mechanism and said second frame section being joined to the post means.

20. The exercise device as claimed in claim 19 wherein each track member comprises a U-shaped channel section opening laterally and wherein the support means include at least one roller mounted within the U-shaped channel section.

* * * * *